US006678908B2

(12) United States Patent
Borders et al.

(10) Patent No.: US 6,678,908 B2
(45) Date of Patent: Jan. 20, 2004

(54) BARIATRIC SURFACE FOR AN OPERATING ROOM TABLE

(75) Inventors: Richard L. Borders, Cincinnati, OH (US); Richard H. Heimbrock, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 263 days.

(21) Appl. No.: 09/778,607

(22) Filed: Feb. 7, 2001

(65) Prior Publication Data

US 2001/0044971 A1 Nov. 29, 2001

Related U.S. Application Data

(60) Provisional application No. 60/180,519, filed on Feb. 7, 2000.

(51) Int. Cl.[7] ..... A61G 13/12
(52) U.S. Cl. ..... 5/691; 5/600
(58) Field of Search ..... 5/691, 600, 601; 378/177

(56) References Cited

U.S. PATENT DOCUMENTS

| | | | | |
|---|---|---|---|---|
| 1,241,136 A | * | 9/1917 | Meyer | 378/179 |
| 3,065,344 A | | 11/1962 | Chervenka | 378/177 |
| 3,814,414 A | * | 6/1974 | Chapa | 5/601 |
| 3,840,221 A | * | 10/1974 | Hogan | 5/601 |
| 4,669,136 A | | 6/1987 | Waters et al. | 50/601 |
| 4,700,416 A | | 10/1987 | Johansson | 5/81.1 T |
| 4,716,607 A | | 1/1988 | Johansson | 5/81.1 T |
| 4,783,864 A | | 11/1988 | Turner | 5/424 |
| 4,914,760 A | | 4/1990 | Hargest et al. | 5/689 |
| 4,970,738 A | | 11/1990 | Cole | 5/81.1 C |
| 5,029,352 A | | 7/1991 | Hargest et al. | 5/689 |
| 5,036,557 A | | 8/1991 | Fales | 5/81.1 R |
| 5,065,464 A | | 11/1991 | Blanchard et al. | 5/81.1 R |
| 5,077,843 A | | 1/1992 | Dale et al. | 5/600 |
| 5,083,332 A | | 1/1992 | Foster et al. | 5/185 |
| 5,121,756 A | | 6/1992 | Koledin | 5/628 |
| 5,422,928 A | * | 6/1995 | Payne | 378/177 |
| RE35,468 E | | 3/1997 | Newman | 5/81.1 R |
| 5,613,254 A | | 3/1997 | Clayman et al. | 5/600 |
| 5,628,078 A | | 5/1997 | Pennington et al. | 5/618 |
| 5,642,537 A | | 7/1997 | Johnson | 5/81.1 HS |
| 5,715,548 A | | 2/1998 | Weismiller et al. | 5/624 |
| 6,065,165 A | | 5/2000 | Delk et al. | 5/628 |
| 6,141,806 A | | 11/2000 | Bobey et al. | 5/600 |
| 6,195,820 B1 | | 3/2001 | Heimbrock et al. | 5/623 |
| 6,202,231 B1 | | 3/2001 | Heimbrock et al. | 5/623 |
| 6,266,831 B1 | | 7/2001 | Heimbrock | 5/601 |
| 2001/0044971 A1 | * | 11/2001 | Borders et al. | 5/691 |

FOREIGN PATENT DOCUMENTS

| | | |
|---|---|---|
| AU | 163976 | 4/1954 |
| AU | 163976 | 7/1955 |
| DE | 1 275 725 | 8/1968 |
| DE | 19627645 A 1 | 1/1998 |
| GB | 754052 | 8/1956 |
| WO | WO 99/09865 | 3/1999 |

* cited by examiner

*Primary Examiner*—Robert G. Santos
(74) *Attorney, Agent, or Firm*—Bose McKinney & Evans LLP

(57) ABSTRACT

An apparatus is configured to be located on a frame of a patient support, the frame having a top surface configured to support a patient, the top surface having a length dimension and a width dimension. The apparatus includes an overlay positioned over the frame of the patient support, the overlay having an upper surface to support the patient and a lower surface configured to abut the top surface of the patient support. The overlay has a width dimension greater than the width dimension of the top surface. A retainer maintains the overlay in a desired position on the frame.

39 Claims, 9 Drawing Sheets

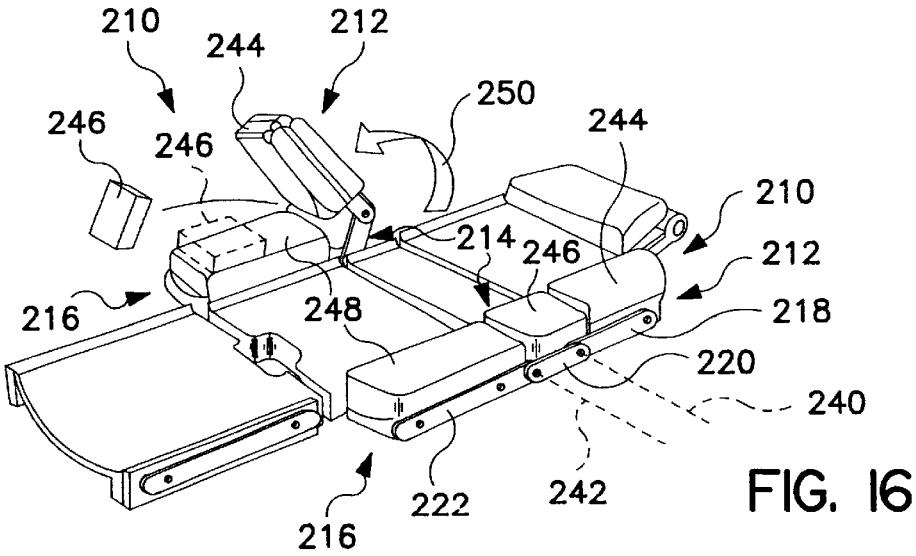
FIG. 16
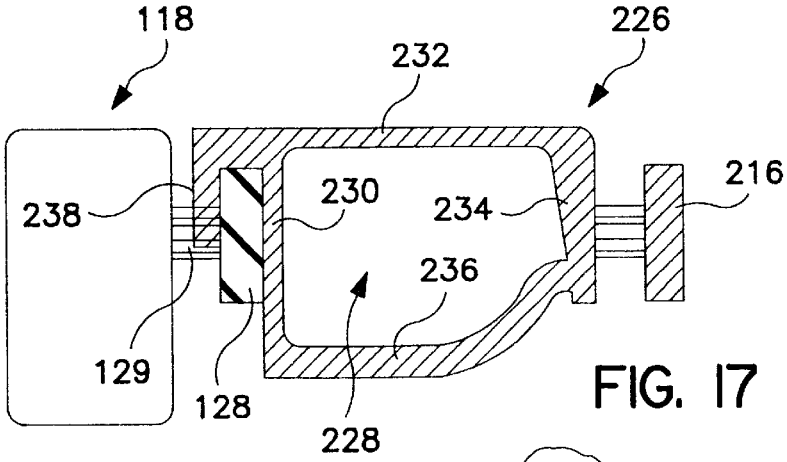
FIG. 17
FIG. 18
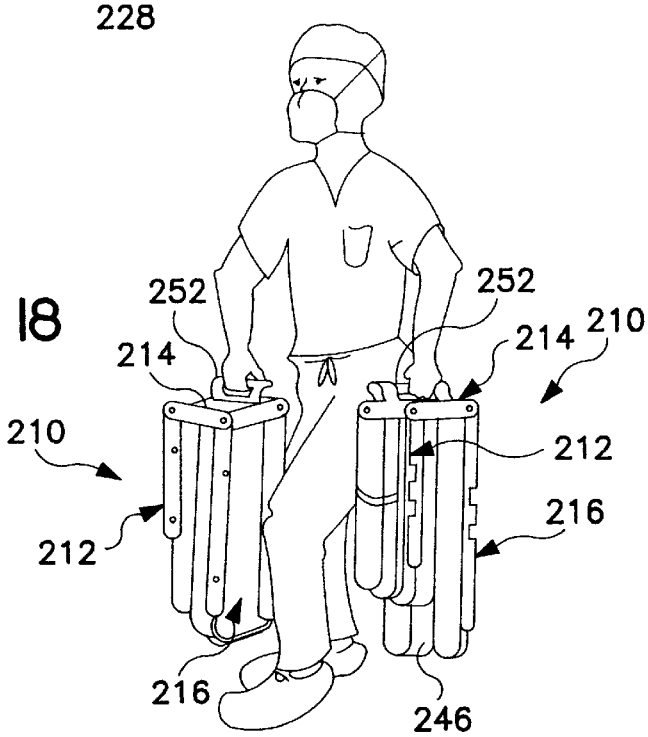

BARIATRIC SURFACE FOR AN OPERATING ROOM TABLE

This application claims the benefit of U.S. Provisional Application No. 60/180,519, filed on Feb. 7, 2000, which is expressly incorporated herein by reference.

BACKGROUND AND SUMMARY OF THE INVENTION

The present invention relates to an accessory item for an operating room or surgical table. More particularly, the present invention relates to a bariatric surface configured to be coupled to a patient support surface of an operating room table to provide a support surface having an increased width to support obese patients.

Operating room tables are well known in the health care industry for supporting patients during surgical procedures. In recent years, operating room tables have been made even more useful and convenient for doctors and nurses by adding various features and options, such as powered articulation of head, torso, and leg sections of the operating room table, height adjustment, tilt adjustment, and the like.

Standard operating room tables include a patient support surface which is about 20–22 inches wide. These conventional patient support surfaces accommodate average size patients well. However, an increasing number of patients are obese. These obese patients are often much wider than average size patients which makes it difficult to use standard operating room tables for these obese patients.

Operating room tables typically are capable of supporting a maximum patient weight of about six hundred pounds. The present invention relates to a bariatric surface which is configured to be coupled to the patient support surface of an operating room table when it is necessary to perform a surgical procedure on an obese patient or any patient having a body width larger than the standard width of the patient support surface of the operating room table. The bariatric surface of the present invention provides a mattress surface having a width wider than the width of a standard operating room table to accommodate obese or wide patients. Illustratively, the width of the bariatric surface is about 28–30 inches. The mattress surface may include foam, air pads/bladders, gel pads, temperature controls, or other support structures to reduce interface pressures between the obese patient and the mattress surface.

The bariatric surface of the present invention illustratively includes a plurality of radiolucent panel sections configured to be coupled to articulating sections of the operating room table. For example, in one embodiment, the panel sections of the bariatric surface include a leg section, a seat section, and a back section configured to be coupled to the operating room table over a leg support, a seat support, and a back support, respectively. Illustratively, a mattress is located above the leg, seat, and back sections of the bariatric surface. The mattress is illustratively removable from the support panel sections for cleaning. In another embodiment, the bariatric surface includes an upper back section, a lower back section, and a seat section located over similarly sized frame sections of a patient support.

In one embodiment, the panel sections of the bariatric surface are illustratively coupled together by flexible straps to facilitate storage and to permit movement of the panel sections relative to each other. In another embodiment, the panels are coupled together about fixed pivot axes. Integrated accessories rails are located on both sides of each panel section of the bariatric surface. This permits positioning of accessories necessary for the surgical procedure on the accessory rails of the bariatric surface.

The bariatric surface of the present invention is easily installed and removed from the operating room table depending upon the specific needs of the patient. The bariatric surface is illustratively constructed from a lightweight, high strength material to facilitate such removal and storage. Therefore, the bariatric surface of the present invention permits the conventional operating room table to be converted into an operating room table capable of handling obese patients without the need to purchase a separate specialty operating room table.

In one embodiment of the present invention, an apparatus is configured to be located on a frame of a patient support, the frame having a top surface configured to support a patient, and the top surface having a length dimension and a width dimension. The apparatus includes an overlay positioned over the frame of the patient support. The overlay has an upper surface to support the patient and a lower surface configured to abut the top surface of the patient support. The overlay has a width dimension greater than the width dimension of the top surface. The apparatus also includes a retainer to maintain the overlay in a desired position on the frame.

In the illustrated embodiment, the frame of the patient support includes first and second spaced apart sides which define the width dimension of the top surface and first and second accessory rails are coupled to the first and second sides of the frame, respectively. The retainer includes first and second members configured to engage the first and second accessory rails, respectively, to maintain the overlay in the desired position on the frame. The overlay illustratively includes first and second side edges located over the first and second accessory rails of the patient support. Third and fourth accessory rails are coupled to the first and second side edges of the overlay, respectively.

Also in the illustrated embodiment, the overlay includes a plurality of panels. Each panel having an upper surface to support the patient and a lower surface configured to abut the top surface of the patient support. The plurality of panels are located at spaced apart positions along a longitudinal axis of the frame of the patient support. Each of the plurality of panels is coupled to an adjacent panel.

Also in an illustrated embodiment of the present invention, an apparatus configured to be located on a frame of a patient support, the frame having a top surface configured to support a patient and first and second spaced apart sides which define a width dimension of the top surface. The apparatus includes a mattress positioned over the frame of the patient support. The mattress has an upper surface to support the patient, a lower surface, and first and second spaced apart side portions which define a width dimension of the mattress which is greater than the width dimension of the top surface of the frame. The mattress has a continuous support surface extending along the width dimension of the mattress. The apparatus also includes a support coupled to the patient support to support portions of the lower surface of the mattress adjacent the first and second sides of the mattress which extend beyond the first and second sides of the frame.

In one illustrated embodiment, the mattress is a one piece mattress section. In another illustrated embodiment, the mattress includes a plurality of mattress sections. Each mattress section has a width dimension which is greater than the width dimension of the top surface of the frame, and each mattress section has a continuous support surface extending along the width dimension of the mattress section.

The present invention also provides an apparatus configured to be located on a frame of a patient support, the frame having at least two frame sections pivotably coupled together about at least one pivot axis, each of the frame sections including a top surface configured to support a patient and first and second spaced apart sides which define a width dimension of the top surface. The apparatus includes a width extender including at least two separate sections which are coupled together, the width extender extending across at least one pivot axis of the frame so that the width extender pivots with the at least two frame sections. The width extender cooperates with the frame to provide a support surface for the patient having an overall width dimension which is greater than the width dimension of the top surface. The apparatus also includes a retainer to maintain the width extender in a desired position on the frame.

Additional features of the present invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which:

FIG. 16 is a perspective view of first and second side extensions according yet to another embodiment of the present invention;

FIG. 17 is a sectional view taken through one of the side extensions of FIG. 16; and FIG. 18 is a perspective view illustrating the first and second side extensions of FIG. 16 in folded, transport configurations.

DETAILED DESCRIPTION OF THE DRAWINGS

Figure 1:
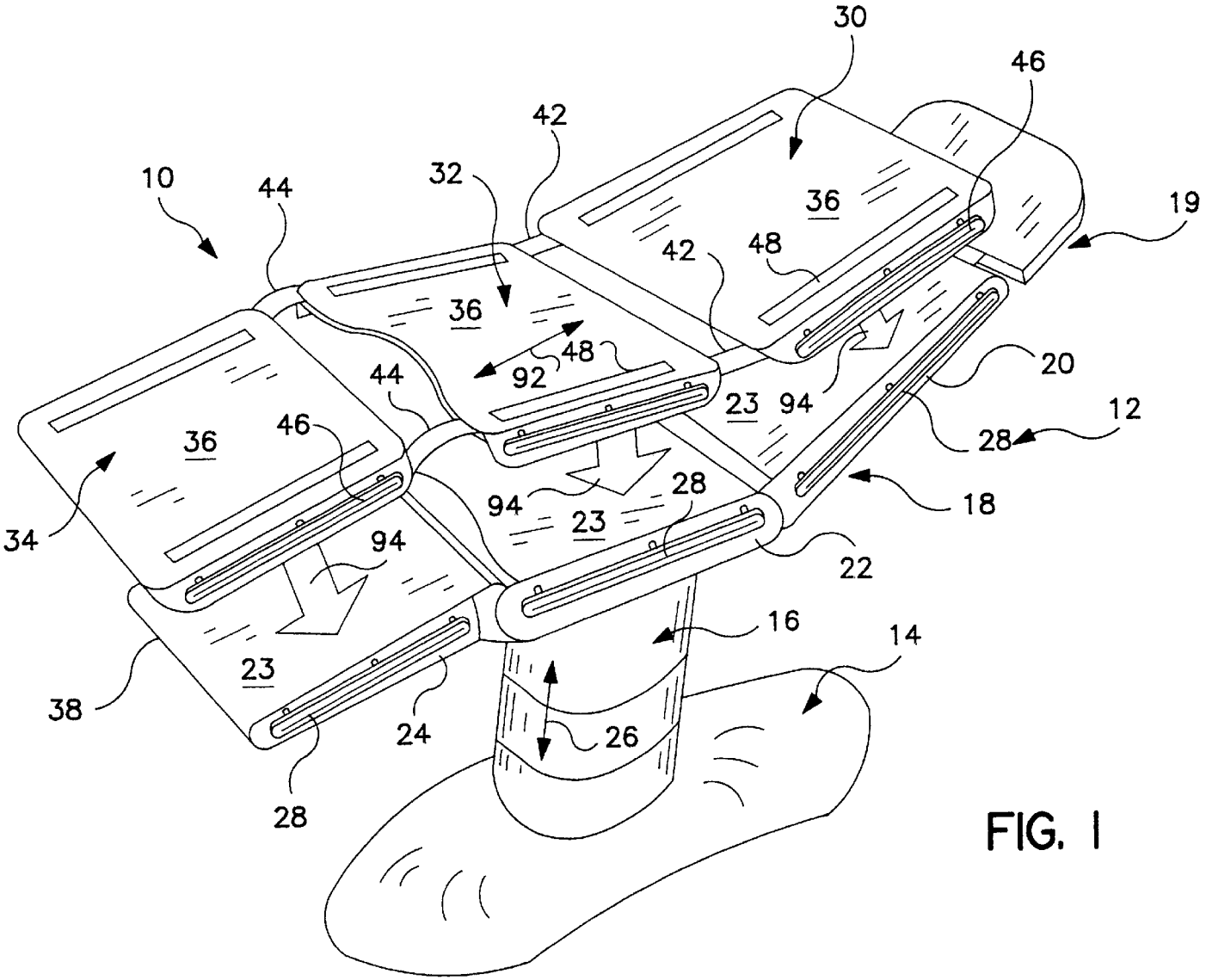
FIG. 1 is a perspective view of an operating room table including a base, a support pedestal, a patient support surface coupled to the pedestal, and a bariatric surface of the present invention spaced apart from the patient support surface of the operating room table to illustrate an installation of bariatric surface onto the patient support surface.

Referring now to the drawings, the present invention relates to an overlay or bariatric surface 10 configured to be coupled to a conventional operating room table 12. The operating room table 12 includes a base 14 and a pedestal 16 coupled to the base 14. An upper patient support frame 18 is coupled to the pedestal 16. The upper patient support frame 18 includes a head section 19, a back section 20, a seat section 22, and a leg section 24. The pedestal 16 includes a hi/lo mechanism (not shown) for adjusting the telescoping pedestal 16 to move the support frame 18 upwardly and downwardly in the direction of the double headed arrow 26 to raise and lower the upper patient support frame 18 relative to the ground.

Details of the operating room table 10 are disclosed, for example, in U.S. application Ser. Nos. 09/187,990 and U.S. Pat. No. 6,073,284, which are incorporated herein by reference. A driver (not shown) such as a cylinder, gear, or other mechanism is used to provide powered pivotal movement of the upper patient support frame 18 about a transverse pivot axis so that the patient support surface 18 is movable between a Trendelenburg position and a reverse Trendelenburg position. In addition, the head frame section 19, the back frame section 20, the seat frame section 22, and the leg frame section 24 are pivotable about spaced apart transverse axes to articulate the patient support frame 18 to desired positions during a surgical procedure. Top panel sections 23 on frame sections 20, 22 and 24 provide a patient support surface for the operating room table 12.

Figure 3:
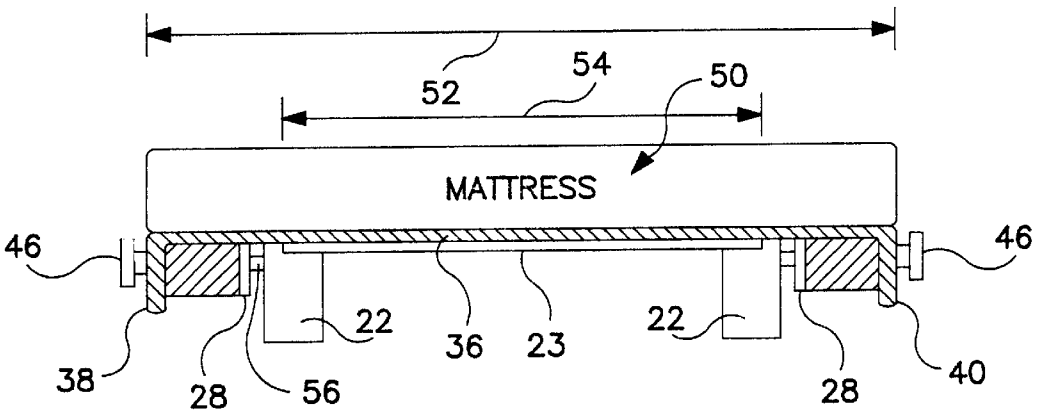
FIG. 3 is a sectional view illustrating the bariatric surface of the present invention installed onto the patient support surface of the operating room table.

Accessory rails 28 are mounted on both sides of the frame sections 20, 22, and 24 of the patient support frame 18 as shown in FIGS. 1 and 3. The accessory rails 28 are used to mount various accessory items to the operating room table 12 during a surgical procedure.

A standard operating room table has a width 54 shown in FIG. 3 of about 20–22 inches which is adequate for handling average size patients. However, an increasing number of patients are obese. Therefore, it is desirable to have a wider patient support surface when necessary to accommodate these wider, obese patients. The bariatric support surface 10 is configured to be coupled to the patient support frame 18 of the operating room table 12 to accommodate these wider, obese patients. The bariatric support surface 10 illustratively includes a back section 30, a seat section 32, and a leg section 34. The back section 30, seat section 32, and leg section 34 of the bariatric surface 10 are configured to be coupled to the back frame section 20, seat frame section 22, and leg frame section 24 of the patient support frame 18, respectively.

Figure 2:
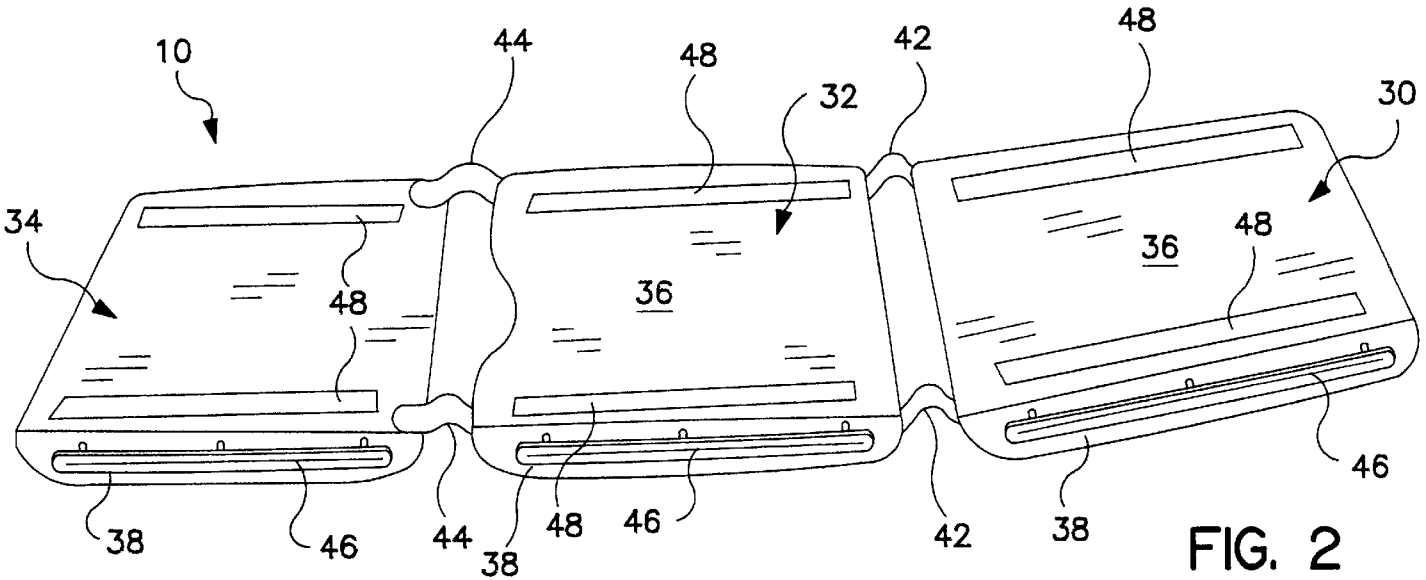
FIG. 2 is a perspective view of the bariatric surface of the present invention.
Figure 4:
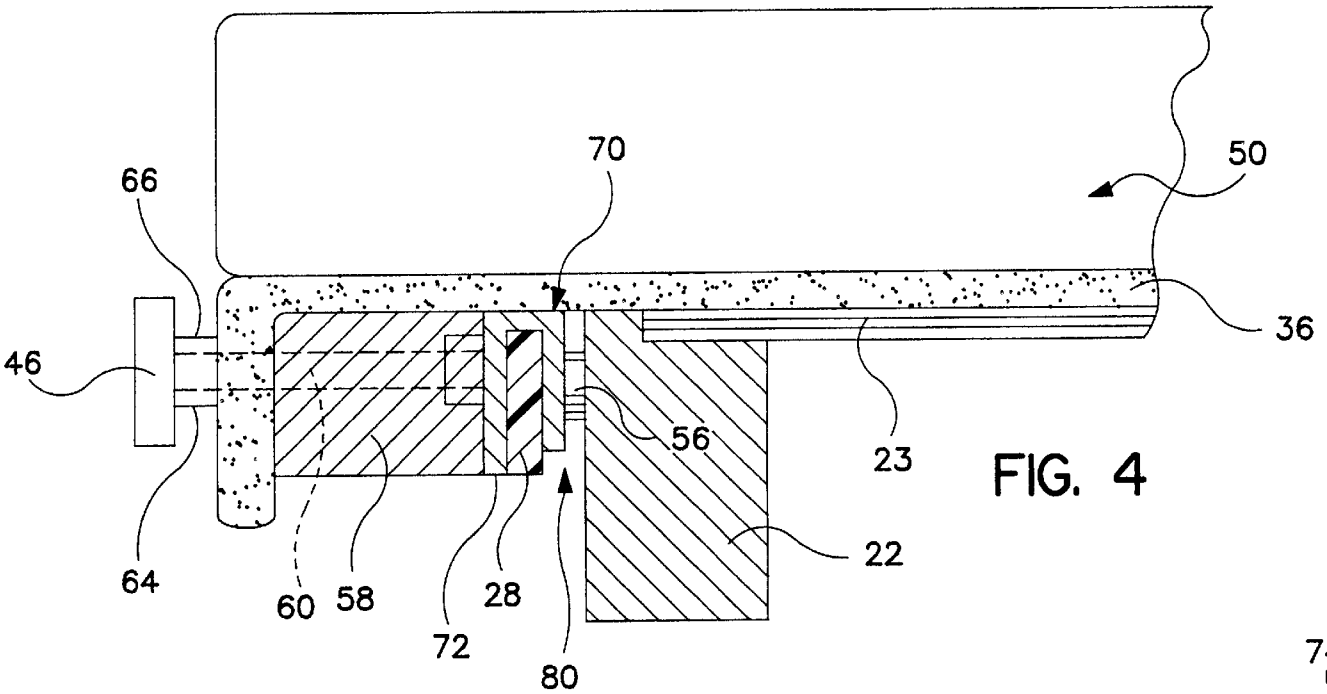
FIG. 4 is an enlarged view further illustrating details of the connection of the bariatric surface of the present invention to an accessory side rail on the operating room table.

As shown in FIGS. 1 and 2, each of the sections 30, 32 and 34 of the bariatric surface 10 include a generally planar top panel 36 having downwardly extending side edges 38 and 40 located on opposite sides of the top panel 36. A pair of flexible straps 42 couples the back panel 30 to the seat panel 32. A pair of flexible straps 44 couples seat panel 32 to leg panel section 34. Each of the back panel section 30, seat panel section 32, and leg panel section 34 includes integrated accessory rails 46 coupled to the downwardly extending side edges 38 and 40 as shown in FIGS. 2 and 3. Each of the top panels 36 includes fastening sections 48 which are illustratively Velcro® fastener strips. These fastening sections 48 are configured to secure a mattress 50 to the top panels 36 of the bariatric surface 10 as shown in FIGS. 3 and 4. The mattress 50 includes mating fasteners such as Velcro® fastener located strips on a bottom surface of the mattress 50. It is understood that other fastening mechanisms may be used to couple the mattress 50 to the top panels 36 in accordance with the present invention, including straps, ties, snaps, clips, glue, or other adhesives, or the like.

Once the back section 30, seat section 32, and leg section 34 of bariatric surface 10 are coupled to the respective sections of the patient support frame 18, the surgical table 12 can be controlled to articulate the patient support sections 20, 22 and 24 in a normal manner. In other words, the sections 30, 32 and 34 of the bariatric surface are capable of movement with the respective sections 20, 22 and 24 of the patient support frame 18 so that the bariatric surface 10 can be moved to any desired position to perform the surgical procedure. Because the back and seat sections 30 and 32 are connected by flexible straps 42 and the seat and leg sections 32 and 34 are connected by flexible straps 44, the sections 30, 32, 34 of the bariatric surface 10 do not have to be coupled together about pivot axes aligned at locations coincident with the pivot axes of the sections 20, 22, 24 of patient support frame 18 in order to permit the frame 18 to move when the bariatric surface 10 is attached.

The panels 36 are illustratively formed from a radiolucent material so that standard imaging procedures can be used on the patient located on the bariatric surface 10. As shown in FIG. 3, the bariatric surface 10 provides a patient support surface having width 52 which is wider than a width 54 of a standard operating room table 12. Illustratively, width 54 is about 20–22 inches, while width 52 is about 28–30 inches or more.

Figure 5:
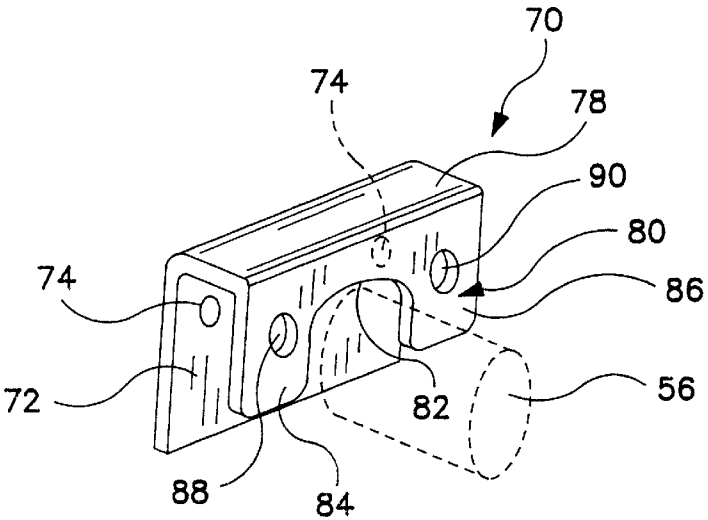
FIG. 5 is a perspective view of an index plate of the present invention which is configured to prevent the bariatric surface from moving longitudinally relatively to the patient support surface of the operating room table as the patient support surface is moved to different positions during a surgical procedure.
Figure 6:
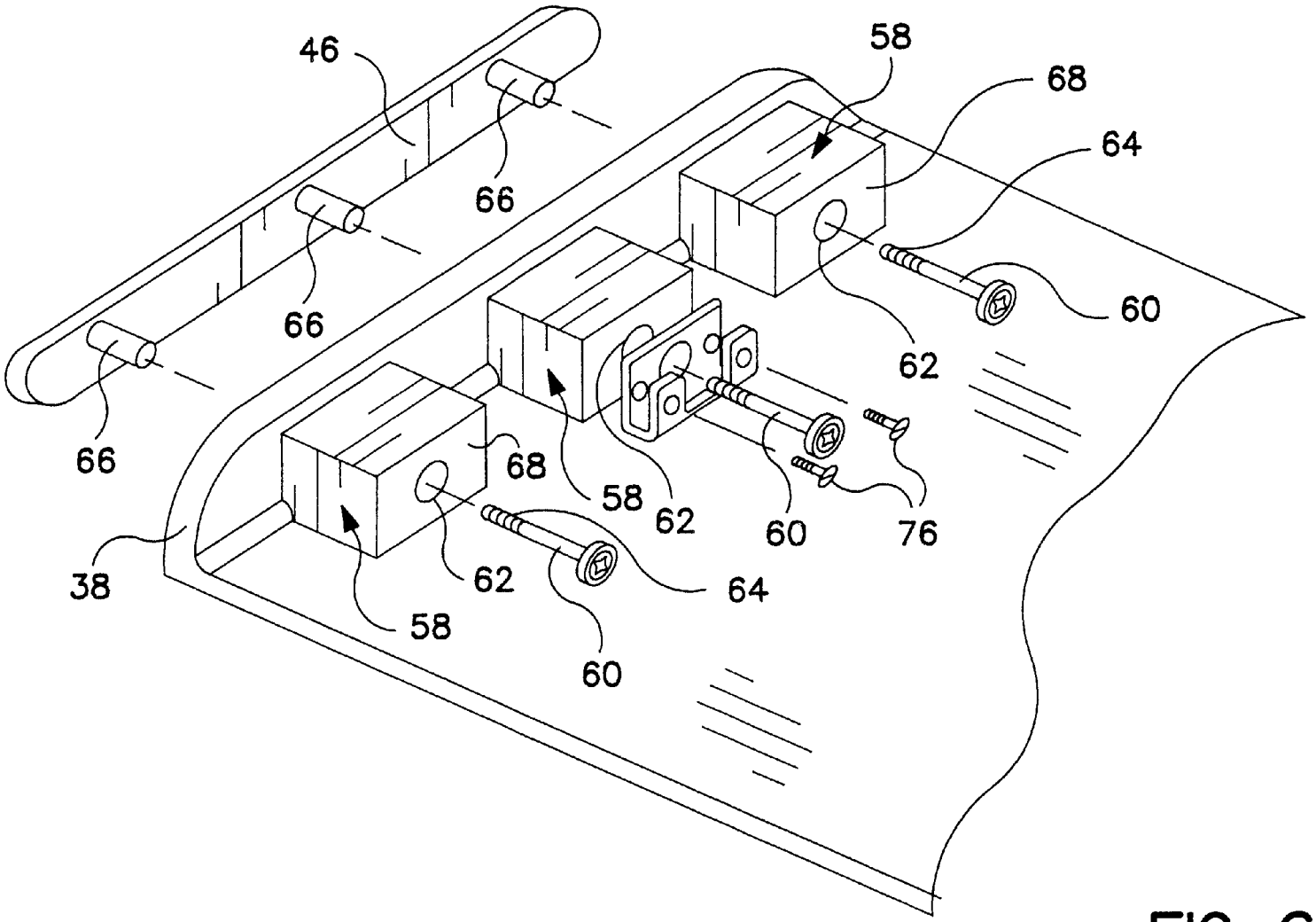
FIG. 6 is an exploded perspective view of a bottom of the bariatric surface of the present invention.

Details of the connection between the bariatric surface 10 and the patient support frame 18 are best illustrated in FIGS. 4–6. In FIG. 4, the top panel section 23 of the seat frame section 22 is formed from a radiolucent material. Accessory rail 28 is coupled to frame section 22 by spaced apart spacers 56.

The bariatric surface 10 is configured to be coupled to the accessory rails 28 on opposite sides of the operating room table 12. As shown in FIGS. 4 and 6, a plurality of spacer blocks 58 are located adjacent the side walls 38 and 40 of each of the back section 30, seat section 32, and leg section 34 of the bariatric surface 10. Spacer blocks 58 are illustratively secured to the sidewalls 38 and 40 by fasteners 60 which extend through central apertures 62 formed in the spacer blocks 58. Fasteners 60 also extend through the sidewalls 38 and 40. Illustratively, fasteners 60 include threaded end portions 64 which are configured to be coupled to threaded portions within spacers 66 coupled to the outer accessory rail 46. In other words, the fasteners 60 secure the spacer blocks 58 and the accessory rail 46 to each of the panel sections 30, 32, 34 of the bariatric surface 10.

As shown in FIG. 4, the apertures 62 of the spacer blocks 58 include a recessed portion so that heads of fasteners 60 are countersunk below an inner wall 68 of the spacer blocks 58. Therefore, the inner wall 68 of each spacer block 58 not having an index plate 70 (discussed below) coupled thereto is configured to abut the accessory rail 28 of the operating room table 12. The top panel 36 of the bariatric surface 10 is configured to extend over and abut the top panel 23 of the patient support frame 18 as shown in FIGS. 3 and 4. Since panels 36 and 23 abut each other, the bariatric surface 10 provides increased panel thickness for additional support of a bariatric patient. Therefore, the bariatric surface 10 extends the width of the top patient support surface of the operating room table 12 as discussed above.

The back section 30, seat section 32, and leg section 34 of bariatric surface 10 each illustratively include index plates 70 which are coupled to one or more of the spacer blocks 58 on opposite sides of each section 30, 32, 34. The index plate 70 is best illustrated in FIG. 5. Each index plate 70 includes an outer wall 72 configured to abut the inner surface 68 of a spacer block 58 as shown in FIGS. 4 and 6. Outer wall 72 includes a pair of apertures 74 configured to receive fasteners such as screws 76. Screws 76 are used to secure the index plate 70 to the selected spacer block 58. Index plate 70 further includes a top wall 78 and a downwardly extending inner wall 80. Inner wall 80 includes a U-shaped portion 82 and first and second arms 84 and 86. U-shaped portion 82 is configured to fit over a cylindrical spacer 56 connected to accessory rail 28 of the operating room table 12. Arms 84 and 86 include apertures 88 and 90, respectively, to permit an operator to access the fasteners 76 with a tool for installation or removal of the index plate 70 from the spacer block 58.

During installation, index plates 70 on opposite sides of each of the back section 30, seat section 32, and leg section 34 extend over a spacer cylinder 56 coupled to the patient support frame 18. Arms 84 and 86 extend over opposite sides of the spacer 56 as shown illustratively in FIG. 5 to prevent movement of the back section 30, seat section 32, and leg section 34 longitudinally relative to the patient support frame 18 during articulation of the back section 20, seat section 22, and leg section 24 of the operating room table 12. In other words, the index plates 70 prevent movement of the sections 30, 32, 34 of the bariatric surface 10 relative to the patient support frame 18 along a longitudinal axis as illustrated by arrow 92 in FIG. 1.

Although the panel 36, accessory rail 46, spacer blocks 58 and index plate 70 are illustrated as separate pieces, it is understood that one or more of those components could be formed integrally with other of the components. In addition, other fastening techniques can be used to secure the components together such as bolts, clamps, adhesives, welding, or the like.

The bariatric surface 10 is lightweight for easy installation. Bariatric surface 10 is lowered onto the patient support frame 18 as shown by arrows 94 in FIG. 1. The index plates 70 are then positioned over the spacer cylinders 56 as discussed above. Inner surfaces 68 of the remaining spacer blocks 58 engage opposite side accessory rails 28 of the surgical table 12 as best shown in FIGS. 3 and 4 to provide support for the top panels 36 of the panel sections 30, 32, 34. The bariatric surface 10 is removed from the operating room table 12 by lifting the bariatric surface 10 off of the operating room table 12. If desired, additional latches (not shown) are provided to secure the bariatric surface 10 to the operating room table 12. Once removed from the operating room table 12, the bariatric surface 10 may be folded for easy storage or transport. Straps 42 and 44 also permit the bariatric surface to be hung on a wall, if desired. Mattress 50 is removable to permit cleaning of the bariatric surface 10 and the mattress 50.

Figure 7:
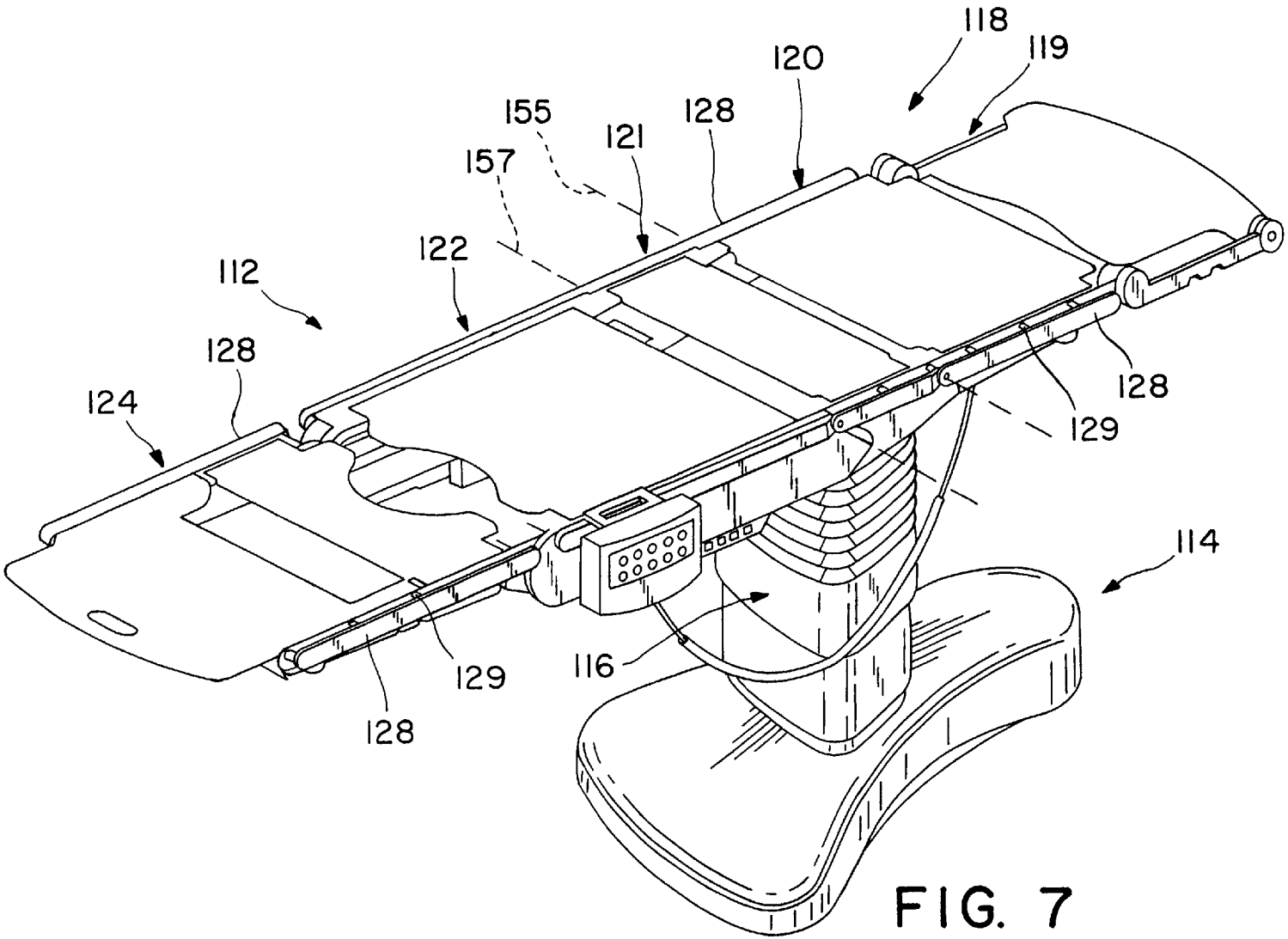
FIG. 7 is a perspective view of another type of operating room table on which a second embodiment of the bariatric surface of the present invention is used.

Another embodiment of the present invention is illustrated in FIGS. 7–14. FIG. 7 illustrates another configuration of operating room table 112 including a base 114 and a pedestal 116 coupled to the base 114. An upper patient support frame 118 is coupled to the pedestal 116. The upper patient support frame 118 includes a head section 119, an upper back section 120, a lower back section 121, a seat section 122, and a leg section 124. Details of the operating room table 110 are disclosed, for example, in U.S. Patent Application Ser. No. 60/264,090, filed on Jan. 25, 2001, entitled SURGICAL TABLE APPARATUS, which is expressly incorporated herein by reference. It is understood that other types of operating room tables may use the bariatric surface of the present invention.

Accessory rails 128 are mounted on both sides of frame sections 120, 122 and 124 of the patient support frame 118 by spaced apart spacers 129 as shown in FIG. 7. The accessory rails 128 are used to mount various accessory items to the operating room table 112 during a surgical procedure.

Figure 8:
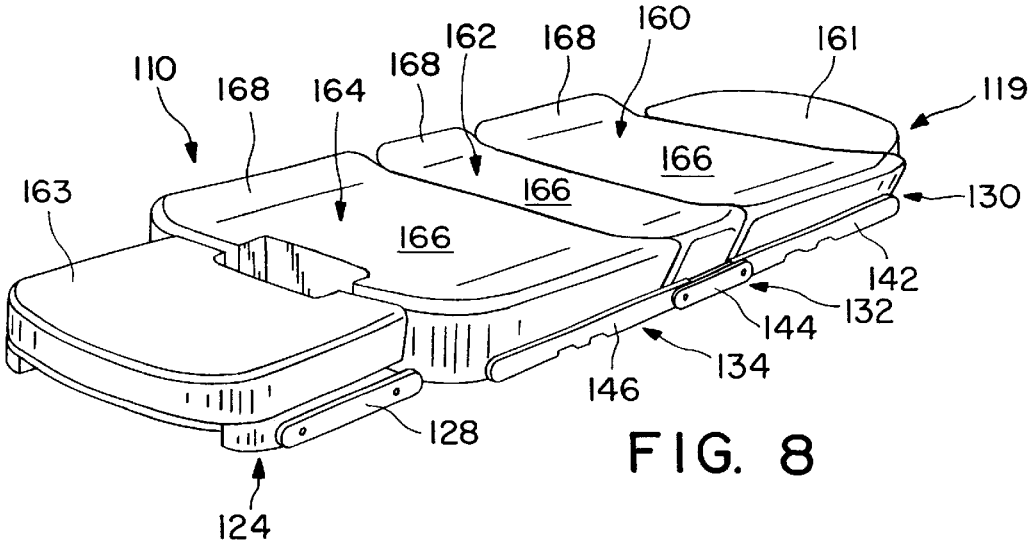
FIG. 8 is a perspective view of the second embodiment of the bariatric surface of the present invention located on the operating room table of FIG. 7.
Figure 9:
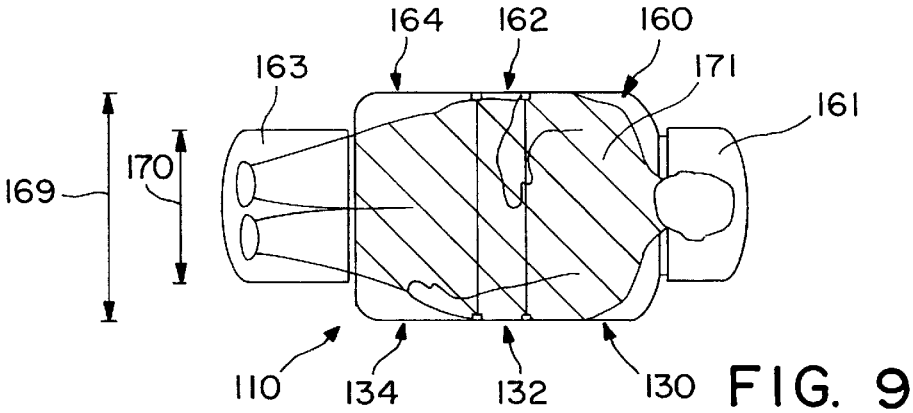
FIG. 9 is a top view of the bariatric surface of FIG. 8 diagrammatically illustrating a patient located on the bariatric surface.
Figure 10:
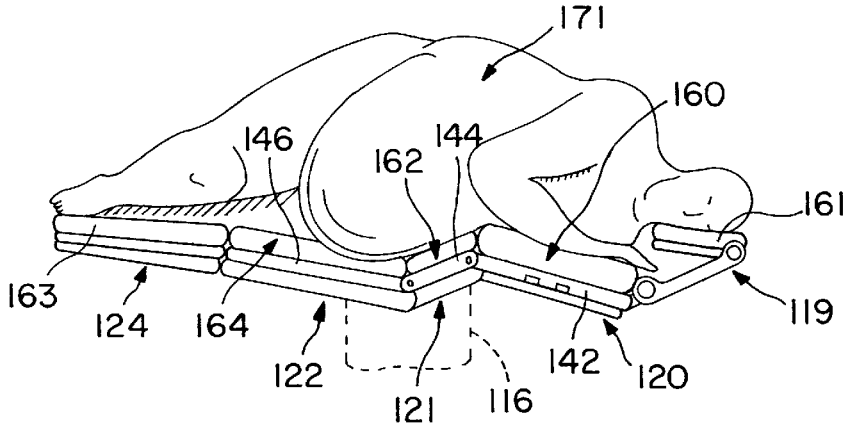
FIG. 10 is a side elevational view of the bariatric surface of FIGS. 8 and 9 illustrating the configuration of the bariatric surface when the operating room table is in a kidney lift position.
Figure 11:
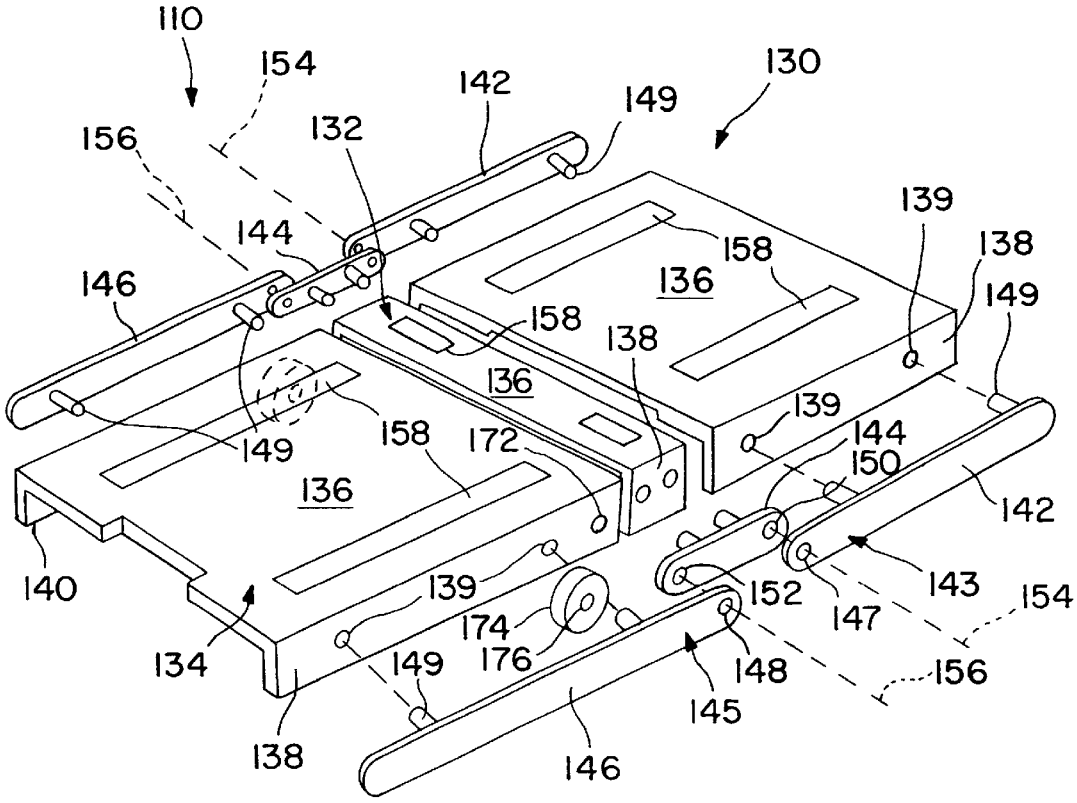
FIG. 11 is an exploded perspective view of a portion of the bariatric surface of FIGS. 8–10.

FIGS. 8–10 illustrate another embodiment of an overlay or bariatric surface 110 of the present invention for use on the operating room table 112 of FIG. 7. As best shown in FIG. 11, the bariatric surface 110 includes an upper back section 130, a lower back section 132, and a seat section 134. The upper back section 130, lower back section 132, and seat section 134 of bariatric surface 110 are configured to be coupled to the upper back frame section 120, the lower back frame section 121, and the seat frame section 122 of the patient support frame 118, respectively.

Figure 12:
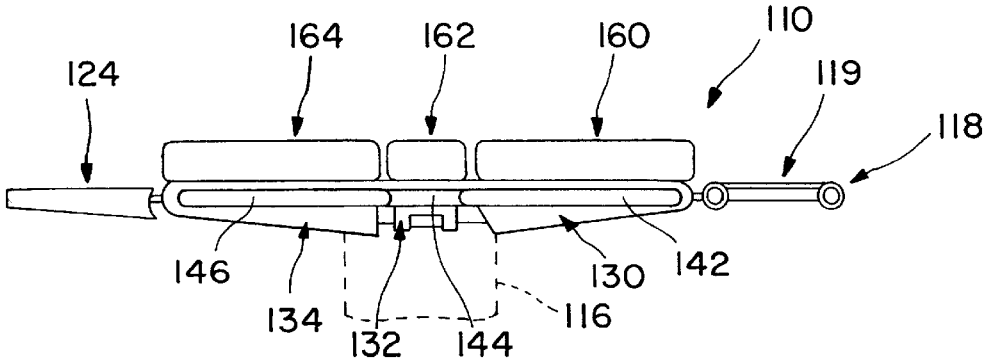
FIG. 12 is a side elevational view of the bariatric surface of FIGS. 8–11 located on the table of FIG. 7.

In the embodiment of FIGS. 11 and 12, each of the sections 130, 132, and 134 of bariatric surface 110 include a general planer top panel 136 having downwardly extending side edges 138 and 140 located on opposite sides of each panel 136. Side edges 138 and 140 are formed to include apertures 139 configured to receive fasteners which secure accessory rails 142, 144, and 146 to the upper back section 130, lower back section 132, and seat section 134 of the bariatric surface 110, respectively. Illustratively, the fasteners (not shown) are coupled to spacers 149 of the accessory rails 142, 144, and 146.

As best shown in FIGS. 11 and 12, end portions 143 and 145 of accessory rails 142 and 146, respectively, overlap opposite ends of center accessory rail 144. Ends 143 and 145 of accessory rails 142 and 146 are formed to include apertures 147 and 148, respectively, which are aligned with apertures 150 and 152, respectively, formed in center accessory rail 144. Fasteners such as pins, rivets, or the like extend through apertures 147 and 150 and through apertures 148 and 152 to pivotably coupled adjacent sections 130, 132 and 134 of the bariatric surface 110 together about pivot axes 154 and 156. In the illustrated embodiments, pivot axes 154 and 156 are aligned with pivot axes 155 and 157, respectively, between the adjacent frame sections 120, 121 and 122 of the operating room table 112.

Each of the top panels 136 includes fastening sections 158 which are illustratively Velcro® fastener strips. As illustrated in FIG. 8, separate mattress sections 160, 162 and 164 are configured to be positioned on the upper back section 130, lower back section 132, and seat section 134 of the bariatric surface 110. It is understood that a single mattress can be used, if desired. In the illustrated embodiment, each of the mattress sections 160, 162 and 164 includes a central support section 166 and upwardly angled side portions 168 located on opposite sides of the central support section 166. The mattress sections 160, 162 and 164 are separately removable from the bariatric surface 110. Illustratively, the mattress sections 160, 162 and 164 include mating fasteners such as Velcro® fastener strips located on bottom surfaces. As discussed above, it is understood that any other fastening mechanisms may be used to couple mattress sections 160, 162 and 166 to the upper back section 130, lower back section 132, and seat section 134 of the bariatric surface 110, respectively. Mattress sections 160, 162 and 164 have substantially the same height as mattress sections 161 and 163 located on the head frame section 119 and leg frame section 124 of the operating room table 112, respectively. Thus, only a body section (not shown) of the operating room table mattress is removed before the bariatric surface 110 is attached. FIG. 12 illustrates the bariatric surface 110 on the operating room table 112 with the mattress sections 161 and 163 removed.

It is understood that a one piece mattress can be used, if desired, instead of separate mattress sections 160, 162 and 164. The one piece mattress or the mattress sections provide a continuous support surface across a width dimension which is greater than the width dimension of the upper patient support frame 118. Therefore, the one piece mattress or the mattress sections provide a continuous support for the patient across the entire increased width dimension without gaps or height differences between adjacent mattress or pad sections.

FIG. 9 illustrates the increased width dimension 169 of the bariatric surface 110 compared to a standard width dimension of the operating room table support frame 118 illustrated by dimension 170. In the embodiment of FIGS. 7–14, the head frame section 119 and leg frame section 124 of the operating room table 112 are used with the wider width bariatric surface 110. It is understood that the bariatric surface 110 may include head and foot sections, if desired.

FIG. 10 illustrates the configuration of the upper patient support frame 118 of the operating room table 112 when it is moved to a kidney lift position. The bariatric surface 110 is also able to move to a kidney lift configuration with the patient support frame 118 of the operating room table 112 for supporting an obese patient 171 in the kidney lift position. Of course, other positions of the upper patient support frame 118 and bariatric surface 110 are achievable as desired.

The side edges 138 of the seat section 134 of bariatric surface 110 are each also formed to include a mounting aperture 172 as shown in FIG. 11. Wheels 174 including central apertures 176 are mounted to the side edges 138 of seat section 134 on an opposite side from accessory rails 146. Illustratively, suitable fasteners extend through apertures 176 and 172 to couple the wheels 174 to the bariatric surface 110. It is understood that other types of wheels may also be mounted to the bariatric surface 110.

Figure 13:
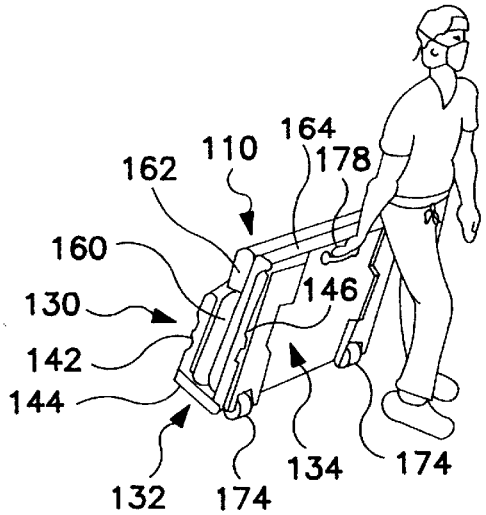
FIG. 13 is a perspective view of the second embodiment of the bariatric surface in a folded, transport configuration.

FIG. 13 illustrates the bariatric surface 110 in a transport configuration. Lower back mattress portion 162 is removable so that the bariatric surface 110 may be folded to the orientation shown in FIG. 13. The lower back mattress portion 162 is then positioned as shown in FIG. 13 and the entire bariatric surface 110 is transported on wheels 174. Suitable couplers (not shown) such as straps, ties, sleeves, or the like are provided to hold the lower back mattress section 162 in place. Alternatively, section 162 may be tethered to section 160 and sections 160 and 162 may be reversed in position for transport. Section 162 can also be nested into the fold below section 160. As shown in FIG. 13, the wheels 174 are mounted inside the side edges 138 and 140. A handle 178 is illustratively formed in or coupled to upper back section 130 of bariatric surface 110 to facilitate transport.

Figure 14:
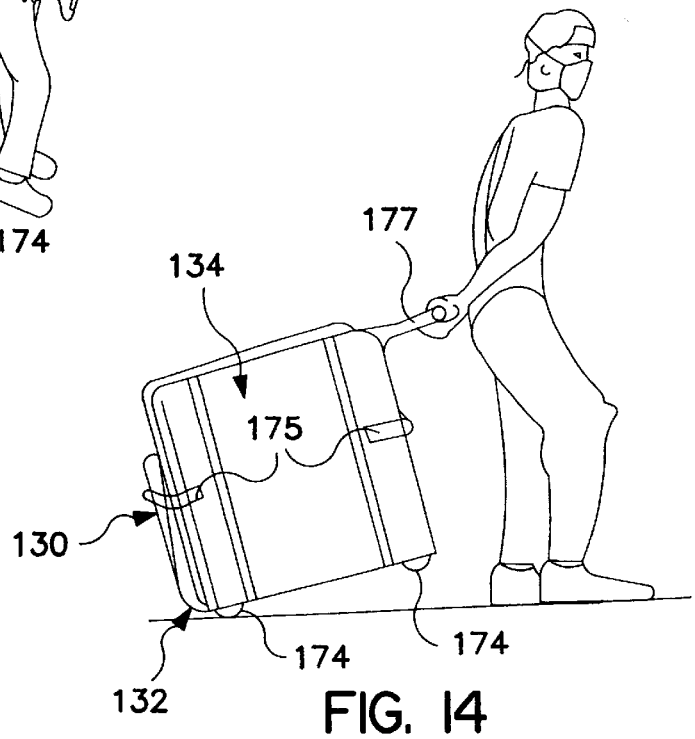
FIG. 14 is a perspective view of a third embodiment of the bariatric surface having an alternate wheel and handle configuration in a transport configuration.

FIG. 14 illustrates another embodiment of the present invention in which the wheels 174 are oriented in an opposite orientation compared to FIG. 13. In the FIG. 14 embodiment, wheels 174 are illustratively coupled to the lower back section 132. Straps 175 are provided to secure the bariatric surface 110 in the folded position. A fold out handle 177 is also provided to facilitate transport.

In one embodiment, the bariatric surface 110 is secured to the accessory rails 128 of operating room table 112 using spacer blocks 58 and index plates 70 as discussed above. In another embodiment, the upper back section 130, lower back section 132, and seat section 134 are formed to include integral spacer blocks and couplers which engage the accessory rails 128 of the operating room table 112 to maintain the bariatric surface 110 in position on the patient support frame 118.

Figure 15:
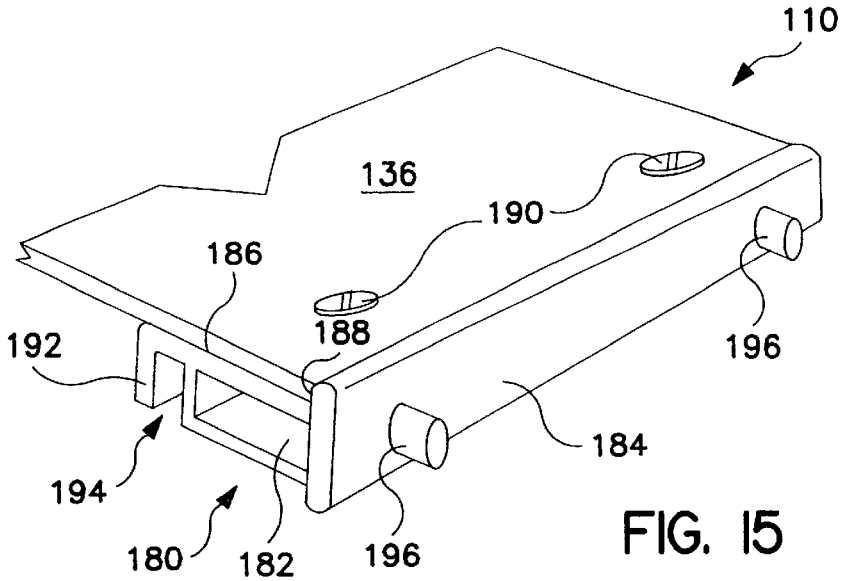
FIG. 15 is a partial perspective view illustrating a support panel and an extrusion of another embodiment of the bariatric surface of the present invention.

Yet another embodiment of the present invention is illustrated in FIG. 15. In this embodiment, the side edges of the upper back section 130, lower back section 132, and seat section 134 of the bariatric surface 110 are formed by an aluminum extrusion 180 having a generally rectangular shaped spacer portion 182 and a side edge 184. Side edge 184 extends above an upper surface 186 of spacer portion 182 to form a lip 188. Top panel 136 of bariatric surface 110 rests on the upper surface 186 of extrusion 180. Panel 136 is illustratively fastened to extrusion 180 by suitable fasteners 190. A downwardly extending flange 192 of extrusion 180 is spaced apart from the spacer portion 182 to define a space 194 therebetween. Space 194 is sized to receive the accessory rail 128 of operating room table 112. Illustratively, flange 192 is formed to include a plurality of notches configured to the positioned over spacers 129 on the accessory rail 128 in a manner similar to the index plate 70 discussed above to prevent the bariatric surface 110 from moving longitudinally relative to the upper patient support frame 118 as the frame 118 is articulated. Spacers 196 are coupled to the side edge 184. Illustratively, spacers 196 are screwed into tapped holes formed in side edge 184. An accessory rail (not shown) is then coupled to the spacers 196 by suitable fasteners.

Another embodiment of the present invention is illustrated in FIGS. 16–18. In this embodiment, side extensions 210 are configured to be coupled to opposite sides of the patient support frame 118 of the operating room table 112. The side extensions 210 each include an upper back section 212, a lower back section 214, and a seat section 216 which include accessory rails 218, 220, and 222, respectively. As best shown in FIG. 17, the various sections of side extensions 210 are illustratively formed from an extruded member 226 having a central body portion 228 including an inner side wall 230, a top wall 232, an outer wall 234, and a bottom wall 236. Also as shown in FIG. 17, the extrusions 226 include an inner flange 238 configured to hook over the accessory rail 128 on the operating room table 112. Flange 128 includes at least one notched portion configured to the located over the spacers 129 of accessory rail 128 to prevent longitudinal movement of the extensions 110 relative to the upper patient support frame 116 of the operating room table 112.

The adjacent sections 212, 214, and 216 are coupled together in a manner discussed above with reference to bariatric surface 110. In other words, the accessory rails 218 and 222 are pivotably coupled to opposite ends of center accessory rail 214 about pivot axes 240 and 242 which are aligned with axes 155 and 157, respectively, of the upper patient support frame 116 of the operating room table 112. Therefore, the side extensions 210 pivot with the upper patient support frame 116 as the frame 116 is articulated.

Support pads 244, 246 and 248 are located over the upper back section 218, lower back section 214, and seat section 216 of the side extensions 210, respectively. As discussed above, the pads 244, 246, and 248 are coupled to the upper surfaces 226 of the sections 212, 214 and 216 by suitable fasteners.

The side extensions 210 hang on the accessory rails 128 of the operating room table 112 and illustratively cover an area from the knee to the shoulder of the patient. It is understood that extension sections covering different sections of table 112 may also be provided. A latch (not shown) may be provided to secure the side extensions 210 to the operating room table 112. When the side extensions 210 are removed, the center pad 246 is first removed and the upper back section 212 is pivoted upwardly as illustrated by arrow 250 in FIG. 16. As shown in FIG. 18, handles 252 are provided underneath lower back sections 214 to facilitate transport of the side extensions 210. Illustratively, the removed center pad 246 is coupled to the pad 248 as illustrated by dotted lines in FIG. 16 and by solid lines in FIG. 18.

In another embodiment, the side extensions 210 are used to support a one piece mattress or a plurality of mattress sections which provide a continuous support surface across a width dimension which is greater than the width dimension of the upper patient support frame 118. The side extensions 210 provide a support for portions of the mattress that extend beyond the sides of the patient support frame 118. Therefore, the one piece mattress or the mattress sections provide a continuous support for the patient across the entire increased width dimension without gaps or height differences between adjacent mattress or pad sections.

It should be appreciated that the sections of bariatric surfaces 10, 110 and 210 may have any desired lengths, widths or configurations to match support frames 18 and 118 of operating room tables 12 and 112 having differing frame section lengths, widths and configurations.

Although the invention has been described in detail with reference to certain illustrated embodiments, variations exist within the scope and spirit of the invention as described and as defined in the following claims.

What is claimed is:

1. An apparatus configured to be located on a frame of a patient support, the frame having a top surface configured to independently support a patient, the top surface having a length dimension and a width dimension, the apparatus comprising:

a substantially planar overlay positioned over the frame of the patient support, the overlay having an upper surface to support the patient and a lower surface configured to abut the top surface of the patient support, the overlay having a width dimension greater than the width dimension of the top surface, and a retainer to maintain the overlay in a desired position on the frame.

2. The apparatus of claim 1, wherein the frame of the patient support includes first and second spaced apart sides which define the width dimension of the top surface and further comprising first and second accessory rails coupled to the first and second sides of the frame, respectively, the retainer including first and second members configured to engage the first and second accessory rails, respectively, to maintain the overlay in the desired position on the frame.

3. The apparatus of claim 2, wherein the overlay includes first and second side edges located over the first and second accessory rails of the patient support, and further comprising third and fourth accessory rails coupled to the first and second side edges of the overlay, respectively.

4. The apparatus of claim 1, wherein the overlay includes a plurality of panels, each panel having an upper surface to support the patient and a lower surface configured to abut the top surface of the patient support, the plurality of panels being located at spaced apart positions along a longitudinal axis of the frame of the patient support.

5. The apparatus of claim 4, wherein each of the plurality of panels is coupled to an adjacent panel.

6. The apparatus of claim 4, wherein each of the plurality of panels is pivotably coupled to an adjacent panel.

7. The apparatus of claim 4, wherein each of the plurality of panels includes a separate retainer.

8. The apparatus of claim 4, further comprising a plurality of mattress sections, each mattress section being removably coupled to one of the plurality panels.

9. The apparatus of claim 1, wherein the overlay is foldable to facilitate transport of the overlay.

10. The apparatus of claim 9, further comprising at least one wheel coupled to the overlay.

11. The apparatus of claim 10, further comprising a handle coupled to the overlay.

12. The apparatus of claim 1, further comprising a mattress positioned on the upper surface of the overlay.

13. The apparatus of claim 12, wherein the mattress provides a continuous support surface for the patient extending across the entire width dimension of the overlay.

14. The apparatus of claim 1,wherein the overlay includes first and second side edges and a plurality of spacer blocks located adjacent to the first and second side edges and configured to engage opposite sides of the frame of the patient support.

15. The apparatus of claim 1, wherein the frame of the patient support includes a back section, a seat section, and a leg section which are movable relative to each other, and wherein the overlay includes a back panel, a seat panel, and a leg panel located over the back section, seat section, and leg section of the frame, respectively.

16. The apparatus of claim 1, wherein the frame of the patient support includes an upper back section, a lower back section, and a seat section which are movable relative to each other, and wherein the overlay includes an upper back panel, a lower back panel, and a seat panel located over the upper back section, the lower back section, and the seat section of the frame, respectively.

17. The apparatus of claim 1, wherein the overlay is made from a radiolucent material.

18. The apparatus of claim 1, wherein the overlay includes a plurality of separate sections, each of the overlay sections having the same width dimension which is greater than the width dimension of the top surface of the patient support.

19. The apparatus of claim 18, wherein the plurality of overlay sections have different lengths and are located at spaced apart positions along a longitudinal axis of the frame.

20. The apparatus of claim 1, wherein the retainer includes an elongated extrusion coupled to the overlay, the extrusion including portion configured to engage the patient support to maintain the overlay in the desired position on the frame.

21. The apparatus of claim 20, wherein the extrusion also includes a spacer portion configured to engage a side of the frame of the patient support.

22. The apparatus of claim 1, wherein the frame of the patient support includes first and second spaced apart sides which define the width dimension of the top surface and further comprising first and second accessory rails coupled to the first and second sides of the frame, respectively, and wherein the retainer includes an extrusion having a flange configured to engage one of the first and second accessory rails to couple the overlay to the frame.

23. The apparatus of claim 1, wherein the overlay includes a plurality of spaced apart sections each having a top panel and first and second spaced apart side edges, each of the overlay sections also including an accessory rail coupled to each of the first and second side edges, the accessory rails being pivotably coupled to an accessory rail of an adjacent overlay section to pivotably couple each overlay section to the adjacent overlay section.

24. The apparatus of claim 1, further comprising a latch to secure the overlay in a desired position on the frame.

25. The apparatus of claim 1, wherein the width dimension of the overlay is about 6 to about 10 inches wider than the width dimension of the top surface of the patient support.

26. The apparatus of claim 1, wherein the width dimension of the overlay is about 25% to about 50% wider than the width dimension of the top surface of the patient support.

27. An apparatus configured to be located on a frame of a patient support, the frame having a top surface configured to support a patient, the top surface having a length dimension and a width dimension, the apparatus comprising:

an overlay positioned over the frame of the patient support, the overlay having an upper surface to support the patient and a lower surface configured to abut the top surface of the patient support, the overlay having a width dimension greater than the width dimension of the top surface, the overlay including a plurality of panels, each panel having an upper surface to support the patient and a lower surface configured to abut the top surface of the patient support, the plurality of panels being located at spaced apart positions along a longitudinal axis of the frame of the patient support each of the plurality of panels being coupled to an adjacent panel by at least one flexible strap; and a retainer to maintain the overlay in a desired position on the frame.

28. The apparatus of claim 27, wherein each of the plurality of panels includes a separate retainer.

29. The apparatus of claim 27, further comprising a plurality of mattress sections, each mattress section being removably coupled to one of the plurality panels.

30. The apparatus of claim 27, wherein the overlay is foldable to facilitate transport of the overlay.

31. The apparatus of claim 27, wherein the frame of the patient support includes a back section, a seat section, and a leg section which are movable relative to each other, and wherein the overlay includes a back panel, a seat panel, and a leg panel located over the back section, seat section, and leg section of the frame, respectively.

32. An apparatus configured to be located on a frame of a patient support, the frame having a top surface configured to support a patient, the top surface having a length dimension and a width dimension, the apparatus comprising:

an overlay positioned over the frame of the patient support, the overlay having an upper surface to support the patient and a lower surface configured to abut the top surface of the patient support, the overlay having a width dimension greater than the width dimension of the top surface, the overlay including first and second side edges and a plurality of spacer blocks located adjacent to the first and second side edges and configured to engage opposite sides of the frame of the patient support, and a retainer to maintain the overlay in a desired position on the frame, the frame of the patient support including first and second spaced apart sides which define the width dimension of the top surface and further comprising first and second accessory rails coupled to the first and second sides of the frame by a plurality of spacers, and the retainer comprising first and second index plates coupled to the spacer blocks adjacent to first and second sides of the overlay, respectively, the first and second index plates each including first and second spaced apart arms located on opposite sides of one of the plurality of spacers of the first and second accessory rails, respectively.

33. A patient support comprising:

a frame;

a patient support surface coupled to the frame and configured to independently receive a patient thereon, the patient support surface having a length dimension and a width dimension;

a substantially planar overlay configured to be positioned over the patient support surface such that an upper surface of the overlay is configured to receive the patient thereon, the upper surface of the overlay having a width dimension greater than the width dimension of the patient support surface to provide a wider support surface for the patient, the overlay having a lower surface configured to abut the patient support surface; and a retainer coupled to the overlay, the retainer being configured to maintain the overlay in a desired position relative to the patient support surface.

34. The patient support of claim 33, wherein the frame includes first and second spaced apart sides which define the width dimension of the patient support surface, and further comprising first and second accessory rails coupled to the first and second sides of the frame, respectively.

35. The patient support of claim 34, wherein the retainer includes first and second members configured to engage the first and second accessory rails, respectively, to maintain the overlay in the desired position.

36. The patient support of claim 33, wherein the overlay includes a plurality of panels, each panel having an upper surface to support the patient and a lower surface configured to abut the patient support surface.

37. The patient support of claim 33, wherein the width dimension of the overlay is about 6 to about 10 inches wider than the width dimension of the top surface of the patient support.

38. The patient support of claim 33, wherein the width dimension of the overlay is about 25% to about 50% wider than the width dimension of the top surface of the patient support.

39. A method of retrofitting a patient support to handle obese patients comprising:

providing a patient support having a first substantially flat patient support surface thereon, the first patient support surface being configured to independently receive a patient thereon, the first patient support surface having a length dimension and a width dimension, providing a substantially planar overlay configured to be positioned over the first patient support surface, the overlay including an upper surface having a width dimension greater than the width dimension of the first patient support surface, and coupling the overlay to the patient support such that the upper surface of the overlay provides a second patient support surface used to support an obese patient and a lower surface of the overlay abuts the first patient support surface.

* * * * *